United States Patent [19]

Harvey

[11] 4,247,804

[45] Jan. 27, 1981

[54] COLD CATHODE DISCHARGE DEVICE WITH GRID CONTROL

[75] Inventor: Robin J. Harvey, Thousand Oaks, Calif.

[73] Assignee: Hughes Aircraft Company, Culver City, Calif.

[21] Appl. No.: 45,460

[22] Filed: Jun. 4, 1979

[51] Int. Cl.[3] ..... H01J 15/02; H01J 17/14

[52] U.S. Cl. ..... 315/344; 313/161; 313/162; 315/338

[58] Field of Search ..... 315/267, 344, 339, 349, 315/338; 313/198, 161, 162

[56] References Cited

U.S. PATENT DOCUMENTS

| | | | |
|---|---|---|---|
| 4,034,260 | 7/1977 | Lutz | 315/344 |
| 4,034,261 | 7/1977 | Lutz et al. | 315/344 |
| 4,091,310 | 5/1978 | Harvey | 313/161 X |

*Primary Examiner*—Eugene R. LaRoche
*Attorney, Agent, or Firm*—Allen A. Dicke, Jr.; W. H. MacAllister

[57] ABSTRACT

A cross-field discharge plasma is used to supply charge carriers for a grid controlled cold cathode discharge device. A dc magnetic field is employed to sustain the crossed-field discharge when the source grid is active. The device comprises an anode, a cathode, a source grid, and in alternate embodiments, additional control grids. Preferably the magnetic field exists only in the source grid-cathode space and penetrates only weakly, or not at all, into other electrode gaps or spaces. The source grid-cathode plasma is effectively a source of charge carriers, electrons or ions, controlled by the source grid current, the anode current being an approximate linear function of source grid current within limits, and/or controllable by adjustment of control grid potentials.

8 Claims, 6 Drawing Figures

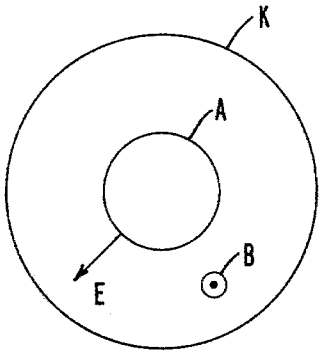
Fig. 1.
(PRIOR ART)
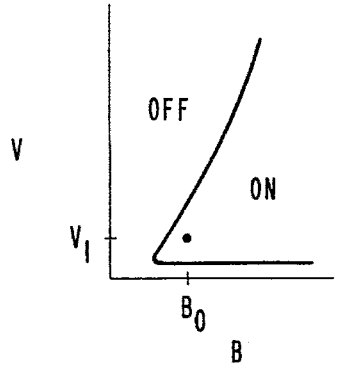
Fig. 2.
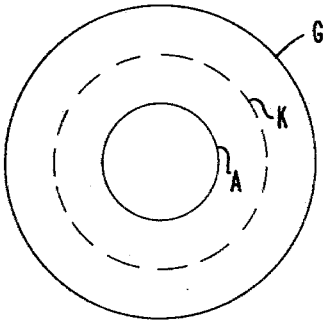
Fig. 3.
(PRIOR ART)
Fig. 5.
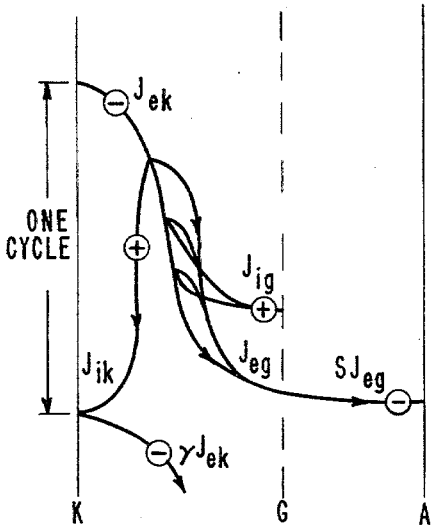

COLD CATHODE DISCHARGE DEVICE WITH GRID CONTROL

BACKGROUND OF THE INVENTION

This invention is directed to a cold cathode, grid-controlled, crossed-field switch which can be repetitively operated in the presence of a fixed magnetic field.

Although this cold cathode discharge device has utility as an amplifier, in the context described herein, the device has primary utility as a closing switch in high frequency pulsed electric power distribution systems or networks.

Background patents of general interest describing the developments in crossed-field switches include U.S. Pat. Nos. 3,638,061; 3,641,384; 3,604,977; 3,558,960; 3,678,289; 3,769,537; and 3,749,978.

In this group, U.S. Pat. No. 3,638,061 permits conduction for reasonable lengths of time without off-switching due to gas losses.

U.S. Pat. No. 3,641,384 describes a unique electrode arrangement in which the electrodes are serially connected to achieve higher holdoff voltages during non-conduction.

U.S. Pat. No. 3,604,977, in a two-electrode crossed-field switch, uses a fixed magnetic field having a field strength above the critical value to enable conduction. One of the electrodes is used to produce a bucking field to reduce the field strength below the critical value for offswitching.

U.S. Pat. No. 3,558,960 introduces an arrangement for maintaining gas pressure in a crossed-field switch for controlling conduction.

U.S. Pat. No. 3,678,289 describes an arrangement for off-switching a crossed-field switch by temporarily reducing the magnetic field to a field strength at which the switch becomes nonconductive.

U.S. Pat. No. 3,769,537 describes a two-electrode crossed-field switch having one perforated electrode and having a baffle adjacent some perforations in a position to limit the maximum electron path length in the absence of a magnetic field to minimize or obviate a reduction in the holdoff voltage.

U.S. Pat. No. 3,749,978 describes the use of sequentially discharged capacitors coupled to an offswitching pulse coil to maintain the magnetic field below the critical value for a desired period.

U.S. Pat. No. RE. 27,557 describes a network of sequentially switched crossed-field switches for increasing circuit resistance.

These patents are of general background interest in setting forth the environment in which crossed-field switches operate, in describing structural details and parameters, and in describing unique switching controls in two-electrode crossed-field switches.

U.S. Pat. No. 4,034,260 is of greater interest in that it describes a three-electrode crossed-field switch. Here, a control electrode, which can be called a grid, is pulsed to electronically switch the tube to a conducting condition. The presence of a magnetic field is required in both the grid-cathode gap and the anode-grid gap for proper triggering and conduction. Off switching is achieved by suppressing or switching off the magnetic field. In this arrangement, the magnetic field may not be fixed but must be cycled for repetitive on and off-switching operation.

Analogies may be drawn to conventional vacuum tubes or the thyratron. But, these are examples of switching devices having thermionic cathodes rather than cold cathodes. Thermionic cathodes have heat sensitive coatings to release electrons in the presence of heat. Thus, a heater is required to boil off the electrons.

SUMMARY OF THE INVENTION

The present invention provides a grid-controlled, cold cathode, crossed-field discharge device having a fixed magnetic field in which the crossed-field discharge plasma exists primarily in the cathode-grid space or gap when the grid is energized and functions as a charge carrier source. This grid (which is herein called a source grid) may be a perforated plate, a woven wire structure, or other open metallic net or rod structure which is transparent to charge carriers, electrons or ions, in a degree to provide high gain from the grid drive current. The arrangement permits a linear control of anode current as a function of grid current up to a fixed limit.

This invention is an improved crossed-field switch which provides switching and/or amplification of high currents in short times at high voltage in a programmed fashion. Being a cold cathode device, a thermionic heater is not required. This switch may be turned on without a warmup time. It does not require a pulsed magnetic field in order to operate repetitively. Control is achievable either by adjusting the source plasma current or by adding control and screen grids.

BRIEF DESCRIPTION OF THE DRAWINGS

These and other features, objects and advantages of the invention will be more fully apparent from the detailed description set forth below taken in conjunction with the drawings in which like reference characters identify corresponding parts throughout and wherein:

FIG. 1 schematically depicts a cylindrical, two-electrode, crossed-field switch representative of prior art.

FIG. 2 is a curve depicting the conditions for conduction of a crossed-field switch.

FIG. 3 schematically depicts a cylindrical, three-electrode switch representative of prior art, particularly U.S. Pat. No. 4,034,260.

FIG. 5 depicts electron and ion migration in the anode, grid and cathode environment of a similar crossed-field switch having three electrodes.

DETAILED DESCRIPTION OF THE INVENTION

Figure 4:
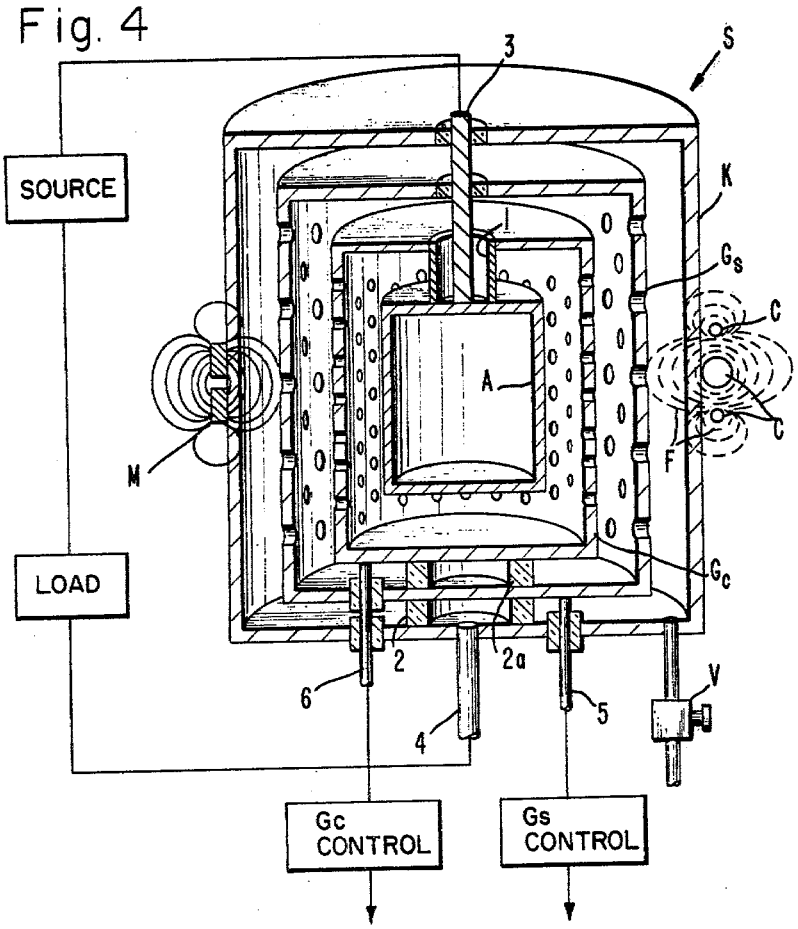
FIG. 4 is a longitudinal cross section of a presently preferred embodiment of this invention.

This invention will be better understood by brief reference to the prior art. Crossed-field switches having two electrodes are referenced in the patents listed hereinabove, and detailed descriptions of background structures are available there.

FIG. 1 schematically depicts the concentric anode A electrode and cathode K electrode structure of a conventional crossed-field tube or switch. These electrodes are of cylindrical configuration. Normally, these electrodes are immersed in a low pressure gas which fills the interelectrode space or gap. This tube is made to conduct by adding an axial magnetic field, depicted at B in the electrode gap, which parallels the confronting electrode faces. This field coupled with the radial electric field depicted at E, which extends across or is transverse of the electrode gap, forms a classical crossed-field discharge configuration.

The conditions for conduction are depicted in FIG. 2, which is a curve plotting the anode-cathode voltage V as the ordinate against magnetic field strength B as the abscissa. For instance, in the presence of an anode-cathode voltage $V_1$, the application of a magnetic field of strength $B_o$ will cause the tube to conduct. For higher anode-cathode voltages, higher magnetic field strengths are required.

As noted in the background discussion in U.S. Pat. No. 4,034,260, improvements are needed since the use of a high field strength pulsed magnetic field introduces time delays, significant jitter in ignition, and magnetic field-induced current losses in the electrodes. High power magnetic field pulses also add to the cost of the switch.

The invention in U.S. Pat. No. 4,034,260 improved performance by achieving onswitching in the presence of magnetic fields of lower field strengths, indicating the need for a crossed-field switch which could be switched on in the presence of anode-cathode voltages in the range of 10 to 100 kilovolts and requiring relatively low magnetic field strengths of the order 0.01 Tesla or 100 Gauss. The improvement in U.S. Pat. No. 4,034,260 comprises the addition of a control electrode or grid G (see FIG. 3) in proximity to the cathode K to achieve electrostatic onswitching by pulsing the grid. The presence of the magnetic field is required in both the grid-cathode gap and the anode-grid gap for proper triggering and conduction. Offswitching is accomplished by pulsing the magnetic field off. Repetitive crossed-field switch operation requires pulsing of the magnetic field.

The invention as described hereinafter employs electrode biasing to produce electron current, it being understood that ions as the charge carriers may be produced by maintaining the source plasma at anode potential.

The present invention improves performance in the provision of a structural organization and mode of operation which obviates the need for pulsing the magnetic field to achieve repetitive operation. This is an important advantage at high switching repetition rates since the anode voltage may be reapplied without switching off the magnetic field. Additionally, the time required to switch the device into the on state is reduced by electrostatically releasing charges across a magnetic field free gap. This is important for operation with submicrosecond pulses.

The crossed-field switch which provides improved switching performance is depicted in FIG. 4. Here, the crossed-field switch S comprises four substantially concentric cylindrical electrodes including an inner anode A, a source grid $G_s$, a control electrode or grid $G_c$ and an outer cathode K. Gas under suitable pressure fills all the electrode gaps or interelectrode spaces. As shown in U.S. Pat. No. 4,034,260, the electrode structure may be enclosed in a gas-filled tank or envelope. Alternatively, as shown in FIG. 4, the cathode K may be used as the enclosure and evacuated and filled with gas through the valve V. Helium at about 50 millitor has been found to provide a suitable gaseous environment for the low pressure glow, crossed-field discharge. Insulators 1, 2 and 2a support the anode A and the grids $G_s$ and $G_c$, respectively, in the concentric positions shown. An array of coils C (shown on the right) or a permanent magnet array M (shown on the left) disposed about the cathode produces a magnetic field F which has an axial component substantially paralleling the electrode faces in the source grid-cathode gap. The leads 3 and 4 provide electrical connections to the anode A and cathode K, respectively. Electrical connection to the grids $G_s$ and $G_c$ are provided by the leads 5 and 6.

In the embodiment of the invention illustrated, the magnetic field-producing arrays are configured so that the magnetic field F ideally extends only into the source grid-cathode gap, as shown, and penetrates only weakly or not at all into the remaining gaps. Thus, unlike the switch of U.S. Pat. No. 4,034,260, which requires penetration of the magnetic field into both electrode gaps, the magnetic field F herein is never strong enough to maintain a plasma in the anode control grid gap, even at low anode voltage. This means that the anode voltage may be reapplied without turning off the magnetic field in the source grid-cathode gap. Magnetic field pulsing is eliminated since only a fixed magnetic field is required.

The mechanism for anode conduction is no longer by means of a crossed-field discharge triggered by penetration of plasma into the anode-grip gap from the grid-cathode gap. Instead, the plasma in the source grid-cathode gap is effectively a source of electrons (and ions) controlled by the grids $G_s$ and $G_c$.

As seen in FIG. 4, the cylindrical grids $G_s$ and $G_c$ are perforated to provide electron transparency in a degree affording high gain with respect to the grid drive currents. Now, the anode current may be controlled linearly with the control grid, as with a vacuum tube, up to a fixed limit.

For high electron currents, the conduction becomes space charge-limited. The accumulation of electrons in the anode control grid gap pulls neutralizing ions through the control grid immersing the grid in plasma. The grid control may then be lost. Once the supply of current to the anode and the control grid is stopped, the plasma is extinguished and the switch recovers to its initial nonconducting state. Throughout this cycle, the magnetic field has not been adjusted. With voltage applied to the anode-cathode terminals of the switch, conduction has been achieved in the presence of the fixed magnetic field in the source grid-cathode gap by the electrostatic field control afforded by the source grid, causing electron migration from the source grid-cathode plasma source into the control grid-source grid gap.

The control grid is not essential for conduction, and, by holding it at anode potential, the electron current will penetrate directly to it causing the switch to begin to conduct as soon as the source plasma forms. This formation requires a finite time (of the order of 0.1 microsecond), and, if the circuit response time is shorter, the rise of current will be limited by the switch. By holding the control grid negative while the source plasma is generated, the start of conduction may be delayed until sufficient plasma is present to support the full circuit current. The control grid is then pulsed positive and allows anode conduction to begin at a more rapid and/or programmed rate. The magnetic field strength required is within the range of permanent magnets, which may be substituted for the field coils, as shown at M in FIG. 4. It will be recognized that additional control of this crossed-field switch may be achieved by adjusting the source plasma current to vary the electron or plasma emission yield or by adding additional auxiliary grids (e.g., suppressor or screen), borrowing from the teachings of the vacuum tube or gas-filled tube art. The analytical considerations which follow are of assistance in understanding this invention.

ANALYSIS

ANODE CURRENT CONTROL WITH A COLD CATHODE PLASMA SOURCE

Introduction

Figure 6:
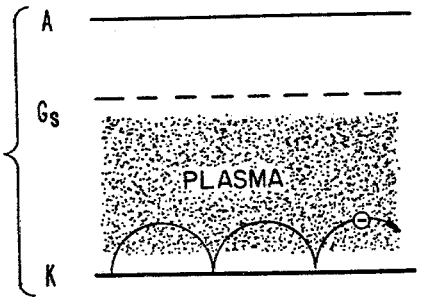
FIG. 6 depicts the migration of a trapped electron at the cathode in the electrode environment of this crossed-field switch.

Refer to the crossed-field switch of FIG. 6 which schematically shows a half-section of a cylindrically symmetric, three-electrode structure. (This may also be viewed as a flat plate structure.) Assuming anode voltage and using a localized steady state magnetic field and by raising the source grid potential, a crossed-field discharge may be initiated in the space between the outer cathode K and the source grid electrode $G_s$. The grid $G_s$ is perforated to produce an effective transparency for incident electrons, S. Once the plasma is formed, an electron current is captured by the anode. The extent of this current is a strong function of S. For large enough S, an anode current flows without any grid current. Beyond this transition point, the anode current is self-sustaining even after the grid is grounded.

At high electron current density, the discharge is space charge-limited, and ions will be extracted from the source plasma in the grid-cathode gap into the anode-grid space or gap. This establishes a plasma potential neutral charge density up close to the anode. The time required to establish equilibrium in this state is governed by the ion transit time. Therefore, ultra-high speed switching operation is best obtained below the space charge limit using a three-electrode device.

Detailed Current Balancing in the Source Plasma

Calculation of the effect of the source grid current (Ig) on the anode current (Ia) requires consideration of the important processes involved. The steady state case is considered here. Referring to FIG. 5, there is depicted the path of a single energetic secondary electron emitted from the cathode by ion bombardment, which collides with neutral gas molecules and generates new charges. In order to be consistent and have the discharge remain in a steady state condition, the average energetic electron must exactly reproduce itself during its active life. Once it passes through the thin cathode sheath in FIG. 6 and picks up an energy $e\phi$, it is unlikely to exactly return to the cathode K and be captured. This is because the magnetic field will usually have a small normal component giving the orbit a slight drift away from the cathode and because some energy is always lost in passing through the plasma. Thus, it is trapped by curving in the magnetic field on the anode side of the sheath and by reflecting off of the repulsive cathode fall potential on the other.

With reference to FIG. 5, the electron loses energy by collisions which often result in ionization. The total number of ionizing collisions (N) may be estimated by assuming that each collision takes away $eV_i$, where $V_i$ is the mean ionization potential. A fraction (E/2) of these may be radiative collisions or wall interactions (captured at the grid or anode). So that $$N = \frac{E}{2}\ \frac{\phi}{V_i} \tag{1}$$

Empirically, $E \lesssim 1$. These collisions produce an equivalent number of ion electron pairs (only first ionizations are assumed here). The ions drift both to the cathode and to the source grid where they are captured. The electrons drift to the grid where a fraction $(1-S)$ is captured, and the bulk (S) penetrates through to the high field region in the grid-anode space and is then captured by the anode. The diagram of FIG. 5 shows schematically the various fluxes of the charged particles ("e" referring to electron and "i" to ion). In order to maintain charge neutrality of the plasma, the net current density at the cathode must be equated to the current density near the grid; i.e.

$$J_{ik}+J_{ek}=J_{eg}-J_{ig} \tag{2}$$

The secondary emission coefficient ($\gamma$) is usually defined by the relationship $$J_{ek}=\gamma J_{ik} \tag{3}$$

Since the ionizing collision process does not markedly alter the velocity of the initial neutral atom, the resulting ions have a random distribution and move in equal numbers toward both the cathode and the grid if the potential is uniform. The probability of neutralizing at those electrodes depends upon the angle of approach, the energy and other geometrical factors; particularly at the grid where some may pass through and be reflected by the field from the anode. All of these factors are taken into account by defining a quantity (Q) such that $$\left|\frac{J_{ik}}{J_{ig}}\right| = \frac{1+Q}{1-Q} \tag{4}$$

with Q varying from $-1$ to 1.

Typically $J_{ig}$ might be slightly less than $J_{ik}$ due to a small potential gradient and reflections from the grid spacing. Thus, Q is likely to be small but positive.

Combining equations 2, 3 and 4 yields $$J_{eg} = \frac{2+\gamma(1+Q)}{1-Q} J_{ig}$$

Gain

Gain is defined as the relationship between the anode and grid currents. Taking the surface areas to be A, the cathode anode and grid currents are defined as:

$$I_K = J_{eg}A - J_{ig}A = J_{eg}A\left[1 - \frac{1-Q}{2+\gamma(1+Q)}\right]$$

$$I_A = SJ_{eq}A$$

and $$I_G + I_A = I_K$$

Thus $$I_K = \frac{I_A}{S}\left[1 - \frac{(1-Q)}{2+\gamma(1+Q)}\right]$$

$$I_G = \frac{I_A}{S}\left[1 - \frac{(1-Q)}{2+\gamma(1+Q)}\right] - I_A$$

-continued $$= \frac{I_A}{S}\left[(1-S) - \frac{(1-Q)}{2+\gamma(1+Q)}\right]$$

Finally, the gain of the device is obtained in terms of the following ratio:

$$\text{GAIN} \equiv I_A/I_G = \frac{S}{(1-S) - \frac{(1-Q)}{2+\gamma(1+Q)}} = \frac{1}{\frac{(1+\gamma)\cdot(1+Q)}{S(2+\gamma(1+Q))} - 1}$$

or $$= \frac{1}{S_o/S - 1}$$

where $$S_o = 1 - \frac{(1-Q)}{2+\gamma(1+Q)} \leqq 1$$

The gain, therefore, has a pole at a grid transmission coefficient less than one. This implies that an arbitrarily high anode current may be generated by a small grid current.

When S is larger than the critical value, the gain is negative. Since the anode current cannot reverse, the grid current must reverse. A situation where current flows from the anode and out of the grid and the cathode is analogous to a hollow cathode discharge. This is the usual situation that is observed at high anode current in steady state. If the grid current is stopped, then the grid potential will rise until the ion current to the grid is reduced, the electron capture is enhanced, and the discharge currents are regulated.

Plasma Potential

The number of collisions is given by $$J_{eg} = (N+1)J_{ek}$$

or $$N = \frac{2}{\gamma(1+Q)}$$

Plasma potential $\phi$ is obtained by using N from Equation (1)

$$\frac{E\phi}{2V_i} = \frac{2}{\gamma(1+Q)}$$

$$\phi = \frac{4V_i}{E\,\gamma(1+Q)}$$

If, as above, the grid ion current is suppressed, then S increases. This would in turn reduce the plasma potential because the ion bombardment of the cathode now makes more efficient use of the ions formed in the discharge.

SPACE CHARGE LIMITING

The application of a grid current has been shown to result in a flux of electrons towards the anode. This electron current is regulated by space charge effects. The space limited current is given classically by $$J_{SC} = \frac{2.33 \times 10^{-6}(V-\phi)^{3/2}}{d^2} \text{ (MKS Units)}$$

where d is the grid-anode spacing.

If this is exceeded by the electron flux $SJ_{eg}$, then an excess negative charge will build up which will in turn be neutralized by ions leaking through the grid. Depending upon the dynamics of this process, the plasma potential may temporarily be pulsed positive. Eventually the plasma will bridge the gap, supplying an arbitrarily high current and forcing the anode potential down to a relatively low sustaining value.

From the foregoing it is apparent that the anode current may be controlled in a cold cathode device which uses a crossed-field discharge as a plasma source. The grid to anode current gain depends upon the electron transparency of the grid and the effective ion reflection coefficient of the grid and cathode. The gain has a singularity at a finite value of the transparency. Beyond this, grid control is lost.

Also, continuous grid control is maintained only below an anode current determined by the appearance of space charge limiting of the electron flux or for a time below the ion transit time. This is not a problem for a cold cathode device where large surface areas are practical, nor is it important for closing switch applications.

Although this invention has been described in connection with structures employing cylindrical electrodes the configuration of the electrodes is not a matter of importance as long as needed surface areas are provided. In this respect flat plate electrodes are conceivable. The description and analysis disclose operable crossed-field discharge devices, employing three electrodes, using a fixed magnetic field having primary penetration only in the source grid-cathode electrode gap, and controlled by the electrostatic field of the source grid, improvement or further control being afforded by the four electrode configuration. Alternatively, this crossed-field discharge device may be operated in the presence of electrode bias maintaining the source plasma at anode potential whence ions are provided rather than electrons. Still further the source plasma may be maintained at potentials between above or below the anode and cathode potentials.

What is claimed is:

1. A crossed-field discharge device comprising:

at least three electrodes comprising an anode electrode, a cathode electrode and a source electrode, one of said cathode and source electrodes having open spaces therein to provide transparency to electrons;

electrical insulating means supporting said electrodes in spaced relation, with said source electrode adjacent said cathode electrode, providing two inter-electrode gaps among the three electrodes;

means for maintaining gas under a predetermined pressure in said inter-electrode gaps so that the gas can be ionized for electric conduction between at least two of said electrodes;

means for coupling an electrical circuit to said anode electrode and said cathode electrode whereby an electrical field is produced which extends across said inter-electrode gaps;

means for producing a magnetic field which penetrates the inter-electrode gap between said source electrode and said cathode electrode, but which magnetic field has no functionally significant penetration into the remaining inter-electrode gap, said magnetic field inter-acting with said electrical field in the gaseous environment in said inter-electrode gap between said source electrode and cathode electrode, to produce a plasma which is a source of electron and ion charge carriers; and means for applying a voltage to said source electrode to produce an electrostatic field to cause charge carrier generation and hence migration from said plasma to said anode to initiate conduction of said crossed-field discharge device.

2. A crossed-field discharge device comprising:

at least three electrodes comprising an anode electrode, a cathode electrode and a source electrode, one of said cathode and source electrodes having open spaces therein to provide transparency to electrons said electrodes being cylindrical, and being concentrically positioned;

electrical insulating means supporting said electrodes in spaced relation, with said source electrode adjacent said cathode, providing two inter-electrode gaps among the three electrodes;

means for maintaining gas under a predetermined pressure in said inter-electrode gaps so that the gas can be ionized for electric conduction between at least two of said electrodes;

means for coupling an electrical circuit to said anode electrode and said cathode electrode whereby an electrical field is produced which extends across said inter-electrode gaps;

means for producing a magnetic field which penetrates the inter-electrode gap between said source electrode and said cathode electrode, but which magnetic field has not functionally significant penetration into the remaining inter-electrode gap, said magnetic field inter-acting with said electrical field in the gaseous environment in said inter-electrode gap between said source electrode and cathode electrode, to produce a plasma which is a source of electron and ion charge carriers; and means for applying a voltage to said source electrode to produce an electrostatic field to cause charge carrier generation and hence migration from said plasma to said anode to initiate conduction of said crossed-field discharge device.

3. Apparatus as set forth in claim 1 in which said magnetic field has a component in the electrode gap between said source electrode and said cathode electrode.

4. A crossed-field discharge device comprising:

at least three electrodes comprising an anode electrode, a cathode electrode and a source electrode, one of said cathode and source electrodes having open spaces therein to provide transparency to electrons;

electrical insulating means supporting said electrodes in spaced relation, with said source electrode adjacent said cathode, providing two inter-electrode gaps among the three electrodes;

means for maintaining gas under a predetermined pressure in said inter-electrode gaps so that the gas can be ionized for electric conduction between at least two of said electrodes;

means for coupling an electrical circuit to said anode electrode and said cathode electrode whereby an electrical field is produced which extends across said inter-electrode gaps;

means for producing a fixed magnetic field which penetrates the inter-electrode gap between said source electrode and said cathode electrode, but which magnetic field has no functionally significant penetration into the remaining inter-electrode gap, said magnetic field inter-acting with said electrical field in the gaseous environment in said inter-electrode gap between said source electrode and cathode electrode, to produce a plasma which is a source of electron and ion charge carriers; and means for applying a voltage to said source electrode to produce an electrostatic field to cause charge carrier generation and hence migration from said plasma to said anode to initiate conduction of said crossed-field discharge device.

5. A crossed-field discharge device comprising:

at least three electrodes comprising an anode electrode, and a cathode electrode and a source electrode, one of said cathode and source electrodes having open spaces therein to provide transparency to electrons;

electrical insulating means supporting said electrodes in spaced relation, said source electrode disposed between said anode and said cathode electrodes, providing two inter-electrode gaps among the three electrodes;

means for maintaining gas under a predetermined pressure in said inter-electrode gaps so that the gas can be ionized for electric conduction between at least two of said electrodes;

means for coupling an electrical circuit to said anode electrode and said cathode electrode whereby an electrical field is produced which extends across said inter-electrode gaps;

means for producing a magnetic field which penetrates the inter-electrode gap between said source electrode and said cathode electrode, but which magnetic field has no functionally significant penetration into the remaining inter-electrode gap, said magnetic field inter-acting with said electrical field in the gaseous environment in said inter-electrode gap between said source electrode and cathode electrode, to produce a plasma which is a source of electron and ion charge carriers; and means for applying a voltage to said source electrode to produce an electrostatic field to cause charge carrier generation and hence migration from said plasma to said anode to initiate conduction of said crossed-field discharge device.

6. A crossed-field discharge device comprising:

at least four electrodes comprising an anode electrode, a cathode electrode, a source electrode and a fourth electrode, said fourth electrode and one of said cathode and source electrodes having open spaces therein to provide transparency to electrons;

electrical insulating means supporting said electrodes in spaced relation with said source electrode adjacent said cathode and said fourth electrode disposed between said source electrode and said anode to serve as a control grid;

means for maintaining gas under a predetermined pressure in said inter-electrode gaps so that the gas can be ionized for electric conduction between at least two of said electrodes;

means for coupling an electrical circuit to said anode electrode and said cathode electrode whereby an electrical field is produced which extends across said inter-electrode gaps;

means for producing a magnetic field which penetrates the inter-electrode gap between said source electrode and said cathode electrode, but which magnetic field has no functionally significant penetration into the remaining inter-electrode gap, said magnetic field inter-acting with said electrical field in the gaseous environment in said inter-electrode gap between said source electrode and cathode electrode, to produce a plasma which is a source of electron and ion charge carriers;

means for applying a voltage to said source electrode to produce an electrostatic field to cause charge carrier generation and hence migration from said plasma to said anode to initiate conduction of said crossed-field discharge device; and means for coupling a negative potential to said control grid until the source plasma has risen the necessary current to provide the anode circuit with sufficient charge carriers to provide full conduction and thereafter for pulsing the control grid to positive potential to initiate conduction with a low power signal.

7. Apparatus as set forth in claim 1 in which electrical potentials are applied to said electrodes so that the source plasma is at anode potential and supplying ions to achieve conduction.

8. Apparatus as set forth in claim 1 in which electrical potentials are applied to said electrodes to cause said source plasma to supply electrons to achieve conduction.

* * * * *